US006619780B1

(12) United States Patent
Agarwal et al.

(10) Patent No.: US 6,619,780 B1
(45) Date of Patent: Sep. 16, 2003

(54) SERVICING METHOD

(75) Inventors: Manish Agarwal, Singapore (SG); Michael Nordlund, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 20 days.

(21) Appl. No.: 10/119,980

(22) Filed: Apr. 10, 2002

(51) Int. Cl.[7] ..... B41J 2/165
(52) U.S. Cl. ..... 347/23
(58) Field of Search ..... 347/23, 14, 19, 347/30, 22, 33, 35

(56) References Cited

U.S. PATENT DOCUMENTS 5,847,726 A * 12/1998 Hori ..... 347/23
6,132,026 A 10/2000 Taylor ..... 347/29

* cited by examiner

*Primary Examiner*—Shih-Wen Hsieh
(74) *Attorney, Agent, or Firm*—Richard Main

(57) ABSTRACT

A method for servicing a printhead of an inkjet printing mechanism is provided. Firstly, a plurality of time difference information is collected by the printing mechanism. Each time difference information represents a period of time passed between end of a last print job and receipt of a succeeding print job. The print jobs are sent from a computer connected to the printing mechanism. Subsequently, the printing mechanism uses the plurality of time difference information to determine a nominal time information representing an amount of time. After the determination of the nominal time information, the printing mechanism periodically performs a first level servicing dependent upon the nominal time information.

10 Claims, 3 Drawing Sheets

SERVICING METHOD

BACKGROUND

This invention relates generally to inkjet printing mechanisms, and in particular to techniques for servicing a printhead of an inkjet printing mechanism.

Inkjet printing mechanisms such as thermal inkjet printers and piezoelectric printers use pens which shoot drops of liquid colorant, referred to generally herein as "ink," onto a page. Each pen has a printhead formed with very small nozzles through which the ink drops are fired during printing operations. The printhead can easily dry out if the printer is not used for a period of time. The drying out occurs because the solvent part of the liquid ink stored in the printhead evaporates. Solids left behind after the evaporation tend to clog the passages and orifice plate of the printhead and may consequently cause the performance of the printhead to be reduced. One way to prevent or at least slow down the evaporation of the ink is to cap the printhead during the period when the printer is not active. Such a capping usually happens when a print job has been executed. However, capping of the printhead and the necessary removing of the capping prior to executing the print job may reduce the quality of the first printout after removing the capping. To improve the quality of the printout, printer designers generally introduce a servicing routine for cleaning the printhead after removing the capping and before executing a print job. Such a servicing routine is called out-of-cap servicing and is done to make sure that the printer, specifically, the printhead is in a satisfactory functional state.

Regarding when to perform the out-of-cap servicing, one practice is that the printer performs the servicing only when a print job comes in. Normally, such a servicing takes quite an amount of extra time to meet the quality requirement of the printout. Since the extra time is taken after the print job is sent but before the print job is executed, the time between a user clicking a "PRINT" button on the user's printer driver and the first sheet of the print job being printed out can be unsatisfactorily long. In other words, the throughput of the printer may not be satisfactory.

Alternatively, the printer can perform the out-of-cap servicing immediately upon being switched-on along with an additional servicing right before a print job is executed. However, such a proactive servicing may not satisfy both requirements for printout quality and printer throughput at the same time in that the printer still needs to select the kind of additional servicing, which is performed prior to the print job. In the conventional practice, the selection is normally fixed and may not achieve the optimal balance between the throughput and the quality of printout for different users with different behaviors. In addition, the proactive servicing upon the printers being switched on may be unnecessary or redundant in such a situation that the printer is switched off before it has received any print jobs.

Therefore, there is a need for an improved servicing method that is more user-adaptive and may better meet both requirements for printout quality and throughput.

SUMMARY

According to an aspect of the present invention, in a method for servicing a printhead of an inkjet printing mechanism, a plurality of time difference information is collected by the printing mechanism. Each time difference information represents a period of time passed between end of a last print job and receipt of a succeeding print job. The print jobs are sent from a computer connected to the printing mechanism. Subsequently, the printing mechanism uses the plurality of time difference information to determine a nominal time information representing an amount of time. After the determination of the nominal time information, the printing mechanism periodically performs a first level servicing dependent upon the nominal time information.

In another aspect of the invention, in a method for servicing a printhead of an inkjet printing mechanism, a nominal time information representing an amount of time is firstly determined. If a print job arrives at the printing mechanism before the amount of time has passed since a start point set by the printing mechanism, a first level servicing is performed by the printing mechanism when the print job arrives. If the print job arrives at the printing mechanism after the amount of time has passed since the start point, the first level servicing is performed when the amount of time has just passed.

In a third aspect of the invention, a medium having a program recorded thereon is provided. The program makes an inkjet printing mechanism execute a procedure for servicing a printhead of the inkjet printing mechanism. The procedure includes the following steps collecting a plurality of time difference information by the printing mechanism, each time difference information representing time passed between end of a last print job and receipt of a succeeding print job, the print jobs being sent from a computer connected to the printing mechanism;

using the plurality of time difference information by the printing mechanism to determine a nominal time information representing an amount of time; and after the determination of the nominal time information, periodically performing a first level servicing by the printing mechanism dependent upon the nominal time information.

In a fourth aspect of the invention, a computer program element is provided and makes an inkjet printing mechanism execute a procedure for servicing a printhead of the inkjet printing mechanism. The procedure includes collecting a plurality of time difference information by the printing mechanism, each time difference information representing time passed between end of a last print job and receipt of a succeeding print job, the print jobs being sent from a computer connected to the printing mechanism;

using the plurality of time difference information by the printing mechanism to determine a nominal time information representing an amount of time; and after the determination of the nominal time information, periodically performing a first level servicing by the printing mechanism dependent upon the nominal time information.

Other aspects and advantages of the invention will become apparent from the following detailed description taken in conjunction with the accompanying drawings, which illustrates by way of example the principles of the invention.

DETAILED DESCRIPTION

Figure 1:
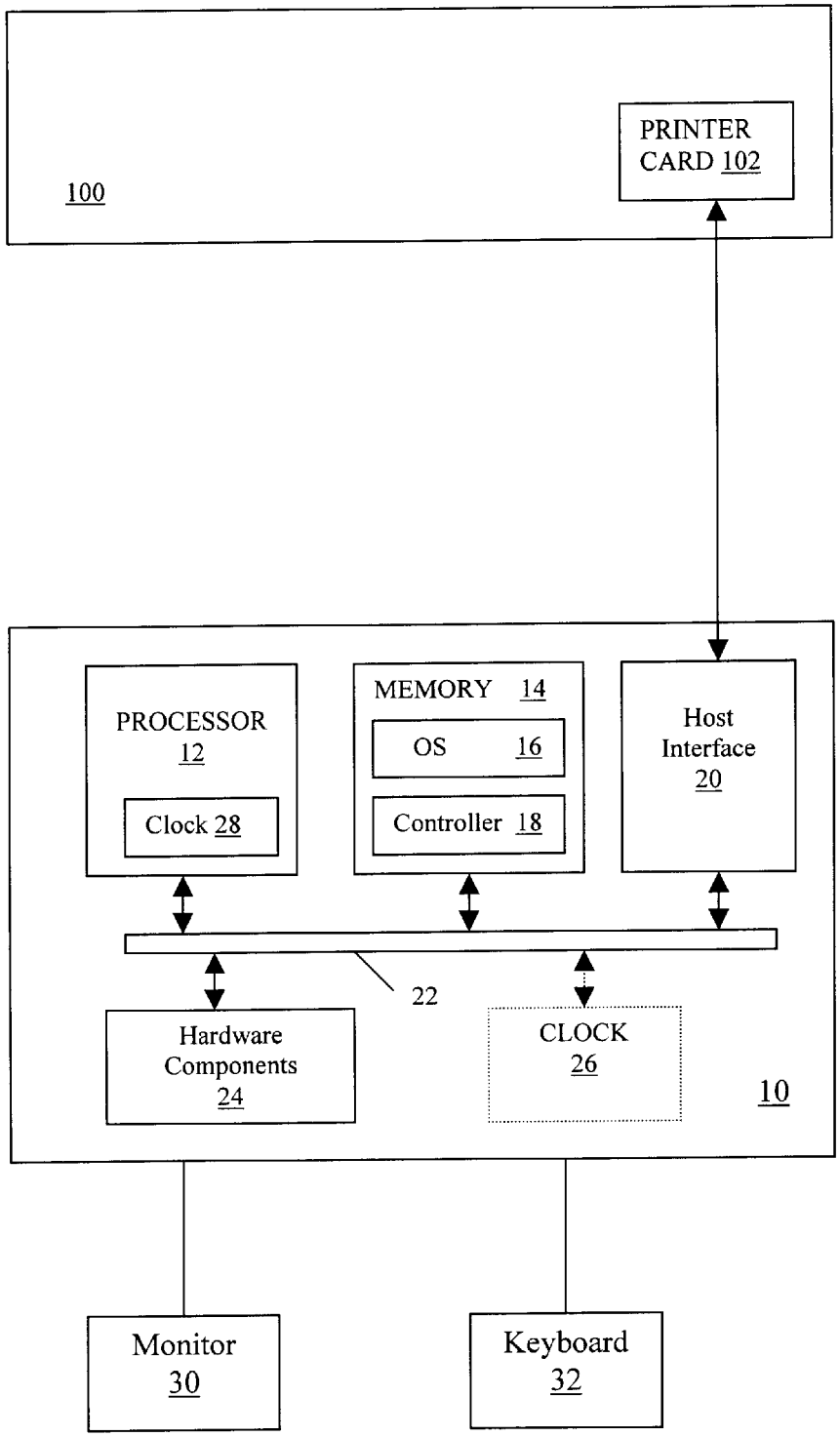
FIG. 1 is a diagram of a computer system including a computer and a printer which system can be used in an embodiment of the invention.

With reference of FIG. 1, shown is a computer system that includes a computer 100 with a plurality of peripheral devices, including for example a printer 10, a monitor 30 and a keyboard 32.

The computer 100 includes a printer card 102 through which the printer 10 is coupled to the computer 100. Print jobs are sent from the computer 100 to the printer 10 through the printer card 102 as is generally known by those with ordinary skill in the art.

The printer 10 includes a processor circuit with a processor 12 and a memory 14, both of which are coupled to a local interface 22. The processor 12 has a standard clock 28 that provides the printer 10 with relative time information. The local interface 22 may be, for example, a data bus with an accompanying control/address bus as is generally known in this field. The printer 10 also includes host interface 20 that provides an interface between the local interface 22 and the printer card 102. In this respect, the printer card 102 and the host interface 20 each may include a port or a receptacle that will accommodate a data communications cable or other communications media therebetween.

The printer 10 also includes various printer hardware components 24 such as, motors, indicator lights, sensors, cartridges having printhead and other components that are driven and/or communicate with the processor circuit in the printer 10 during the courses of general printer operation. The printer may further include a wiping mechanism (not shown) for servicing the printhead and a capping mechanism (not shown) for capping the printhead after the execution of a print job or at the time when the printer is switched off. A detailed description of the various printer hardware components 24 and of their function is not provided herein as is such as generally understood by those with ordinary skill in the art. For instance, a service station is disclosed in U.S. Pat. No. 6,132,026, which is assigned to the present assignee, Hewlett-Packard Company, and is incorporated herein by reference.

The printer 10 further includes various software components stored on a memory 14 including, the operating system 16 and a printer controller 18. Specifically, the operating system 16 controls the allocation and usage of the memory 14, processing time, and the peripheral devices as well as performing other functionality. In this manner, the operating system 16 serves as the foundation on which applications depend as is generally known by those with ordinary skill in the art.

In an exemplary embodiment of the invention, the printer 10 may include a built-in real time clock 26, which provides real time information to the printer. In such a case, the printer may easily obtain the time information requested in the subsequently described process.

In a second exemplary embodiment of the invention, the printer 10 does not have such a built-in real time clock 26. Instead, the printer 10 only has a standard clock 28 embedded within the processor 12, and the standard clock 28 only provides relative time information. In that case, each print job sent by the computer 100 may contain a date and time information representing the absolute date and time when the print job is sent to the printer 10. Such a date and time information can be retrieved by the printer 10 when the print job arrives at the printer. As a result, the printer 10 becomes aware of the absolute date and time when the print job arrives at the printer.

In the following description, only the second exemplary embodiment in which the printer 10 does not have a built-in real time clock is discussed. In addition, for the purpose of simplicity, the date and time information will also be abbreviated as date-time-stamp.

Figure 2:
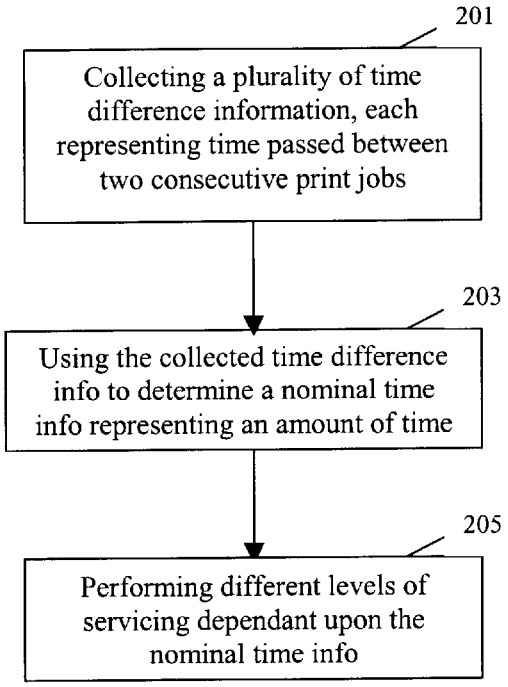
FIG. 2 illustrates a process carried out by the system of FIG. 1.
Figure 3:
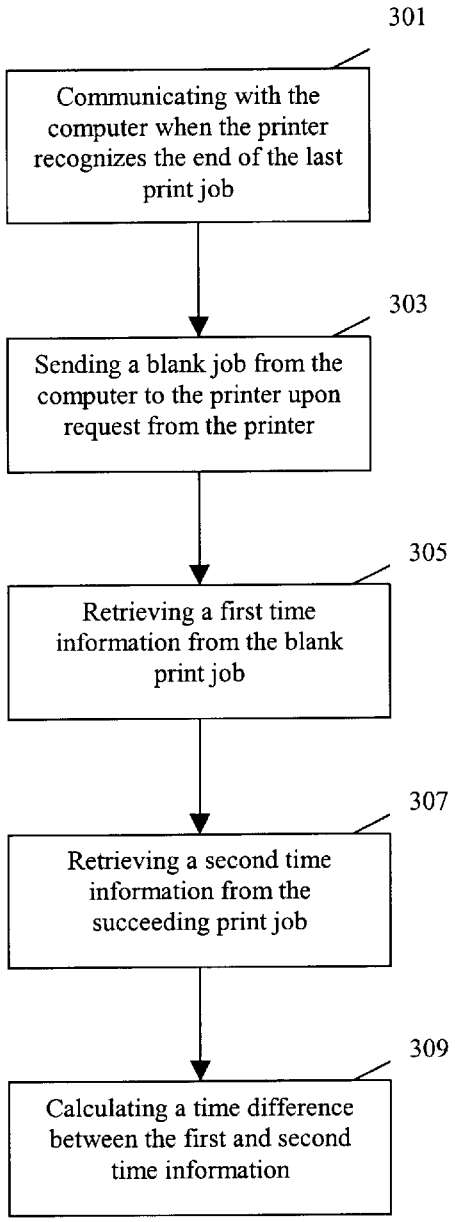
FIG. 3 illustrates in details the step of collecting time difference information shown in FIG. 2.

As shown in FIG. 2, an exemplary embodiment of a method of servicing a printhead of the printer 10 starts with step 201 of collecting a predetermined number of time difference information associated with a plurality of print jobs. Each time difference information represents a period of time passed between the end of a last print job and the receipt of a succeeding print job by the printer. It is understood in this application that the last print job generally refers to a print job that has just been executed, while the succeeding print job generally refers to a print job that is sent to the printer subsequent to the last print job. Each time difference information is collected by steps 301–309 as shown in FIG. 3.

Each print job in general contains an end-of-job statement that concludes the data contained within the print job. Upon recognizing the end-of-job statement within the last print job, in step 301 the printer 10 communicates with the computer via a bidirectional communication link therebetween. The computer 100, on the other hand, constantly detects devices connected thereto. Upon detecting the precedingly discussed communication from the printer, the computer 100 sends a blank print job to the printer 10 in step 303. The blank print job does not contain any data except a date-time-stamp and thus will not trigger the printer 10 to perform any printing operations. In addition, the date-time-stamp contained in such a blank print job would represent the absolute date and time of the end of the last print job for the purpose of this application. When the printer receives the blank print job, in step 305, the printer 10 retrieves a first time information, i.e., the date-time-stamp contained in the blank job, and stores in its memory 14. Subsequent to the last print job, a succeeding print job would be sent from the computer 100 to the printer 10. In step 307, when the printer 10 receives the succeeding print job, the printer retrieves a second time information therefrom, i.e., the date-time-stamp contained in the succeeding print job representing the absolute date and time when the succeeding print job is sent. The time for transmitting a print job from the computer 100 to the printer 10 is inherent in the computer system and hence has not been specifically excluded. Thus, the date-time-stamp contained in the succeeding print job also represents the absolute date and time when the printer 10 receives such a succeeding print job. Subsequently, in step 309, by calculating a difference between the two date-time-stamps retrieved in steps 305 and 307, the printer obtains a time difference information representing a period of time passed between the end of last print job and the receipt of the succeeding print job.

Precedingly discussed is a normal switch-off case that the switch-off happens after the completion of a print job. There can be a situation that the printer is switched off during the execution of a print job and is switched on later on. In such a case, time passed between the receipt of the last print job before the printer is switched off and the receipt of the first succeeding print job after printer is switched on would be collected as the time difference information for the purpose of step 201.

In addition, the memory 14 stores the date-time-stamps retrieved in steps 305 and 307 independent of the power supply of the printer 10. Thus, even if the printer 10 is switched off, the printer 10 is still able to determine the time difference information in step 309 after being switched on in that the printer can easily retrieve the date-time-stamp associated with the last print job from its memory.

By repeating steps 301–309 for a predetermined number of times, the printer 10 collects the predetermined number of time difference information. Subsequently, in step 203 the printer 10 uses the collected plurality of time difference information to determine a nominal time information representing an amount of time. In particular, the printer builds a statistical distribution of the collected plurality of time difference information and relates the nominal time information to the first statistical point at which the next print job is most likely to arrive at the printer. A normal distribution is used as an exemplary embodiment in the current application, in which embodiment the printer 10 calculates a mean (hereinafter "u") as well as a variance (hereinafter "v") of the statistical distribution. The nominal time information is set as u−3v in such an exemplary embodiment.

The nominal time information will be used by the printer 10 in its subsequent operations to determine when to perform an out-of-cap servicing. The nominal time information is stored in the memory 14 of the printer 10 independent of the power supply of the printer 10.

Figure 4:
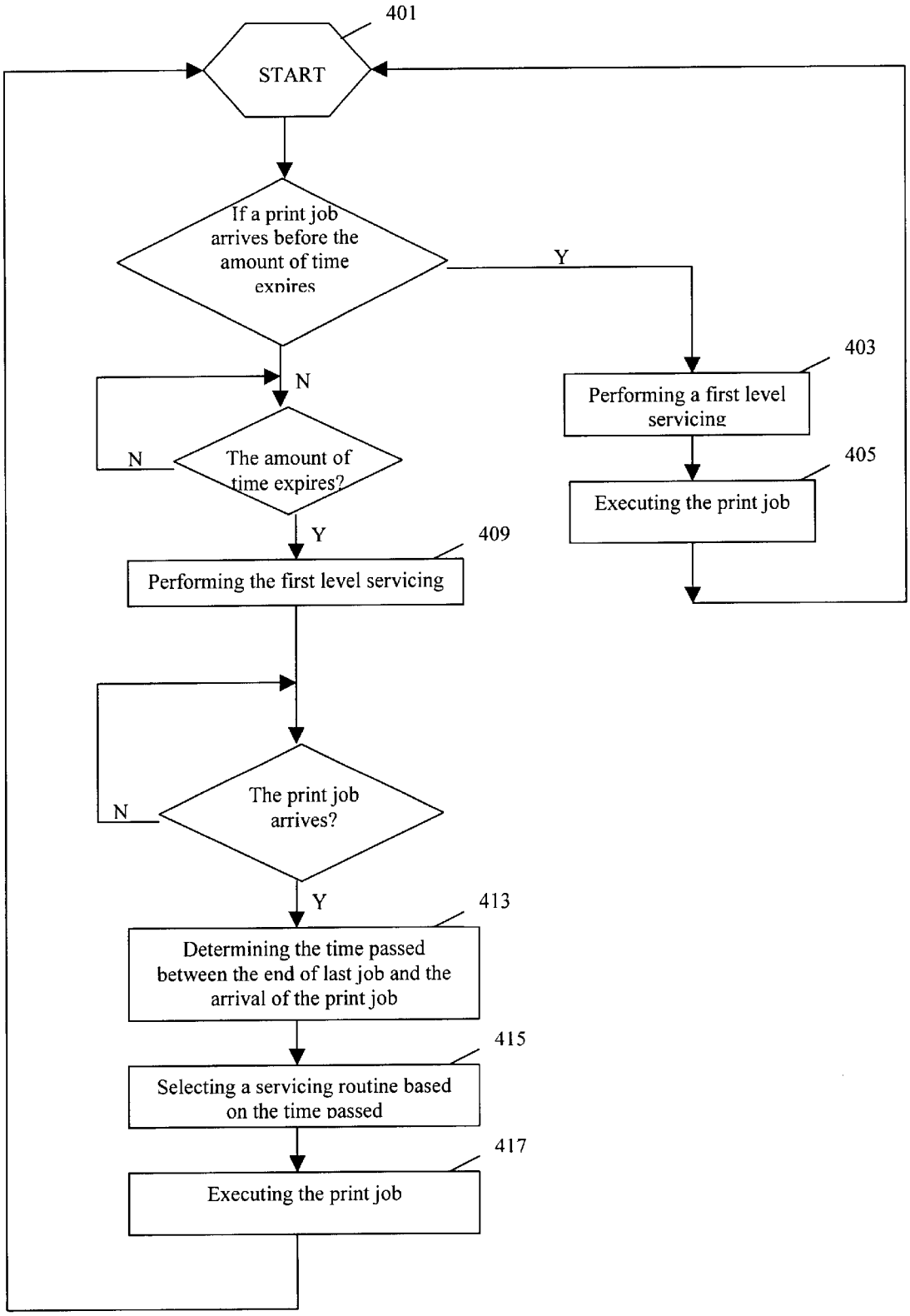
FIG. 4 illustrates in details the step of periodically servicing the printhead shown in FIG. 2.

Then in step 205, the printer 10 periodically performs an out-of-cap servicing depending upon the nominal time information. Step 205 is better illustrated in steps 401–417 with reference to FIG. 4. Further, it is assumed that a last print job has been executed when the process enters step 205.

In addition, three different levels servicing, i.e., a first, a second and a third level servicing, are provided in steps 401–417. In particular, in the exemplary embodiment, the first level servicing may represent a thorough servicing of the printhead and may include, for example, sequential actions of spitting, dry wiping, spitting, wet wiping and spitting. The second level servicing may be spitting X drops per nozzle, and the third level servicing may be spitting Y drops per nozzle, where X=n*Y with n being a function of the printhead, ink and the printer design. The selection among these three levels relates to the timing when a print job arrives, which will be further discussed.

As the process enters step 401, the printer 10 keeps track of the time passed ever since the end of the last print job. For this purpose, the printer uses the standard clock 28 within the processor for relative time measurement, in conjunction with the state-time-stamp retrieved from the print jobs for absolute time measurement.

If a print job arrives before the amount of time of u−3v has passed since the end of the last print job, the printer 10 performs the first level out-of-cap servicing in step 403 and executes the print job in step 405. The process then goes back to step 401. Note that after the execution, the print job would become "a last print job" in this application.

If a print job has not arrived when the amount of time of u−3v has passed since the end of the last print job, in step 409 the printer 10 performs the first level out-of-cap servicing at the time when such an amount of time has passed since the end of the last print job.

Subsequent to step 409, when a print job arrives, in step 413 the printer calculates a period of time passed between the end of the last print job and the arrival of the print job. If the value of such a period is less than u, which means that the print job arrives within a period of 3v from the latest first level servicing, in step 415, the printer 10 performs the second level out-of-cap servicing. If the value of such a time is more than u, which means that the print job arrives after a period of 3v has passed since the latest first level servicing, in step 415, the printer 10 performs the third level out-of-cap servicing instead. After the second or third level servicing in step 415, the process enters step 417, in which the print job is executed. Then the process goes back to step 401. Note that after the execution, the print job would become "a last print job" in this application.

It is understood that during the time when the printer is switched off, it does not perform any servicing or execute any print jobs. In the case that the printer 10 is switched off and then switched on, considerations are made regarding different situations that may happen during steps 401–417. For example, in the case that the printer 10 is switched off and then switched on, the computer 100 is configured to send the printer a blank job with a date-time-stamp incorporated therein upon the printer being switched on. In this way, the printer 10 realizes the real time by retrieving such a date-time-stamp. The printer then compares the value of such a date-time-stamp with the value of the date-time-stamp that is stored in the memory and represents the end of the last print job the printer receives before being switched off. If the difference between these two values is more than u−3v, the process enters step 409 directly. Otherwise, the process starts with step 401. In addition, if a print job arrives at the printer during the time when the printer is switched off, the printer enters step 403 directly when it is subsequently switched on.

In summary, the exemplary embodiment of the invention introduces a nominal time information for determining the timing to perform a thorough out-of-cap servicing, i.e., the first level out-of-cap servicing. Such a nominal time information is determined by building a statistical distribution dependent upon a plurality of time difference information, each of which represents a period of time passed between two consecutive print jobs. As a result, the nominal time information generally reflects when the succeeding print job can be expected subsequent to the last print job, and is user-adaptive in that it is determined based upon user behaviors relating to this particular printer. In addition, in the exemplary embodiment, the printer performs a second or a third level servicing, which is a relatively quick servicing, at the time when the succeeding print job actually arrives. From the statistical point of view, in most situations, the succeeding print job will arrive within a period between u−3v and u+3v from the end of last print job. Thus, in most situations, the printer performs a first level servicing first and within a period of 6v performs a second or a third level servicing when the succeeding print job arrives. Since the second or the third level servicing is much faster than a normal out-of-cap servicing such as the first level servicing, the throughput of the printer can be improved. Further, the invention can still maintain the quality of the printout in that a first level servicing has been performed in advance and a second or a third level servicing is performed before the execution of the succeeding print job but within a short period after the first level servicing.

Alternatives can be made to the preceding embodiment. For example, the printer can dynamically update the nominal time information after it has been determined in step 203. For this purpose, the printer needs to keep collecting the time difference information as specified in step 201, and such a collection can be performed after a print job is executed in step 405 or 417. The printer then is capable of using the newly collected time difference information to build a constantly updated statistical distribution so as to determine a constantly updated nominal time information.

Such a dynamically updated nominal time information may make the invented process more sensitive to user behaviors and thus adapt to a new user with different work habits. In addition, the update of the nominal time information can also be done when a certain amount of new time difference information has been collected.

Besides, if the printer 10 has a built-in real time clock, the printer can retrieve time information from such a clock directly, rather than relying upon the date-time-stamp incorporated in the print jobs.

It is apparent that the servicing method herein disclosed adapts itself to the work habits of the user and to differing production situations. Such a servicing method also achieves a balance between the amount of servicing and the time before a print job is executed and thus optimizes both the throughput and the quality of the printout.

What is claimed is:

1. A method for servicing a printhead of an inkjet printing mechanism, comprising:

collecting a plurality of time difference information by the printing mechanism, each time difference information representing time passed between end of a last print job and receipt of a succeeding print job, the print jobs being sent from a computer connected to the printing mechanism;

using the plurality of time difference information by the printing mechanism to determine a nominal time information representing an amount of time; and after the determination of the nominal time information, periodically performing a first level servicing by the printing mechanism dependent upon the nominal time information.

2. The method of claim 1, wherein the step of collecting the plurality of time information includes:

sending a blank print job from the computer to the printing mechanism at the end of the last print job;

retrieving a first time information from the blank print job;

retrieving a second time information from the succeeding print job; and determining a time difference information by calculating a difference between the first time information and the second time information, said steps of retrieving and determining being performed by the printing mechanism.

3. The method of claim 1, wherein the step of determining the nominal time information includes building a statistical distribution based upon the collected plurality of time difference information; and using the statistical distribution to determine the nominal time information.

4. The method of claim 1, wherein the step of periodically performing the first level servicing includes:

if a print job arrives at the printing mechanism before the amount of time has passed since a start point set by the printing mechanism, performing the first level servicing by the printing mechanism when the print job arrives.

5. The method of claim 1, wherein the step of periodically performing the first level servicing includes:

if a print job arrives at the printing mechanism after the amount of time has passed since a start point set by the printing mechanism, performing the first level servicing by the printing mechanism when the amount of time has just passed.

6. The method of claim 5, wherein the step of periodically performing the first level servicing further includes:

performing an additional servicing when the print job arrives.

7. The method of claim 6, wherein the step of performing the additional servicing further includes:

determining a time difference between the time when the first level servicing is performed and the time when the print job arrives; and selecting a servicing routine among a plurality of levels depending on the time difference.

8. A method for servicing a printhead of an inkjet printing mechanism, comprising:

firstly determining a nominal time information representing an amount of time;

if a print job arrives at the printing mechanism before the amount of time has passed since a start point set by the printing mechanism, performing a first level servicing by the printing mechanism when the print job arrives; and if the print job arrives at the printing mechanism after the amount of time has passed since the start point, performing the first level servicing when the amount of time has just passed.

9. A medium, having a program recorded thereon, wherein the program makes an inkjet printing mechanism execute a procedure comprising the following steps for servicing a printhead of the inkjet printing mechanism, comprising:

collecting a plurality of time difference information by the printing mechanism, each time difference information representing time passed between end of a last print job and receipt of a succeeding print job, the print jobs being sent- from a computer connected to the printing mechanism;

using the plurality of time difference information by the printing mechanism to determine a nominal time information representing an amount of time; and after the determination of the nominal time information, periodically performing a first level servicing by the printing mechanism dependent upon the nominal time information.

10. A computer program element which makes an inkjet printing mechanism execute a procedure comprising the following steps for servicing a printhead of the inkjet printing mechanism, comprising:

collecting a plurality of time difference information by the printing mechanism, each time difference information representing time passed between end of a last print job and receipt of a succeeding print job, the print jobs being sent from a computer connected to the printing mechanism;

using the plurality of time difference information by the printing mechanism to determine a nominal time information representing an amount of time; and after the determination of the nominal time information, periodically performing a first level servicing by the printing mechanism dependent upon the nominal time information.

* * * * *